US010897087B2

(12) United States Patent
Chen et al.

(10) Patent No.: US 10,897,087 B2
(45) Date of Patent: Jan. 19, 2021

(54) INTEGRATED SLOT ANTENNA

(71) Applicant: Hewlett-Packard Development Company, L.P., Spring, TX (US)

(72) Inventors: Juhung Chen, Taipei (TW); Leo Gerten, Austin, TX (US); Po Chao Chen, Taipei (TW); Hung-Wen Cheng, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/608,821

(22) PCT Filed: Apr. 18, 2017

(86) PCT No.: PCT/US2017/028028
§ 371 (c)(1),
(2) Date: Oct. 26, 2019

(87) PCT Pub. No.: WO2018/194555
PCT Pub. Date: Oct. 25, 2018

(65) Prior Publication Data

US 2020/0203842 A1 Jun. 25, 2020

(51) Int. Cl.
*H01Q 13/10* (2006.01)
*H01Q 1/24* (2006.01)

(52) U.S. Cl.
CPC ..... *H01Q 13/10* (2013.01); *H01Q 1/241* (2013.01)

(58) Field of Classification Search
CPC ..... H01Q 13/10; H01Q 1/24
USPC ..... 343/770
See application file for complete search history.

(56) References Cited

U.S. PATENT DOCUMENTS

| | | | | |
|---|---|---|---|---|
| 6,664,931 | B1 | 12/2003 | Nguyen et al. | |
| 7,746,288 | B2 | 6/2010 | Wang et al. | |
| 8,022,882 | B2 | 9/2011 | Tsai et al. | |
| 8,441,404 | B2 | 5/2013 | Chiang et al. | |
| 8,489,162 | B1 | 7/2013 | Dou et al. | |
| 9,559,425 | B2 | 1/2017 | Zhu et al. | |
| 2012/0026048 | A1* | 2/2012 | Vazquez | H01Q 5/371 343/725 |
| 2016/0336643 | A1* | 11/2016 | Pascolini | H01Q 9/0421 |
| 2017/0033467 | A1* | 2/2017 | Huang | H01Q 5/357 |

OTHER PUBLICATIONS

N.I. Voytovich et al, Mathematical Models of Slot Antennas, Vestnik Yuurgu, No. 35, 2012, pp. 6-10.
Ban, Y-L. et al., Decoupled Planar WWAN Antennas with T-shaped Protruded Ground for Smartphone Applications, 2014.
Chiu, C-W., et al., An Internal Multiband Antenna for WLAN and WWAN Applications, May 13, 2009, < http://onlinelibrary.wiley.com/doi/10.1002/mop.24501/abstract >.
Wong, K-L, et al, Internal Wideband Metal-plate Antenna for Laptop Application, Jan. 19, 2005.

* cited by examiner

*Primary Examiner* — Andrea Lindgren Baltzell
(74) *Attorney, Agent, or Firm* — HPI Patent Department

(57) ABSTRACT

Examples of an integrated slot antenna are described. The integrated slot antenna comprises a first slot, a second slot and a separating member. The first slot is an open-ended slot and is coupled to a first antenna member to form a first slot antenna. The first slot antenna operates in a first predetermined range of frequencies. The second slot is a close-ended slot and is separated from the first slot by the separating member.

15 Claims, 5 Drawing Sheets

INTEGRATED SLOT ANTENNA

BACKGROUND

Electronic devices such as, laptops, smartphones, tablets are generally compact in size to provide portability to users. The electronic devices are fitted with components that are compact and can be accommodated within housing of the electronic devices. Such components for instance, processor, memory, and display screens, having reduced size and dimensions, utilize a predefined space within the housing of the electronic devices.

However, with growing and widespread use of electronic devices, more number of components are being incorporated within the housing of the electronic devices to enable additional features and functionalities of such devices.

BRIEF DESCRIPTION OF THE DRAWINGS

The detailed description is provided with reference to the accompanying figures. In the figures, the left-most digit(s) of a reference number identifies the figure in which the reference number first appears. The same numbers are used throughout the drawings to reference like features and components.

DETAILED DESCRIPTION

Figure 1:
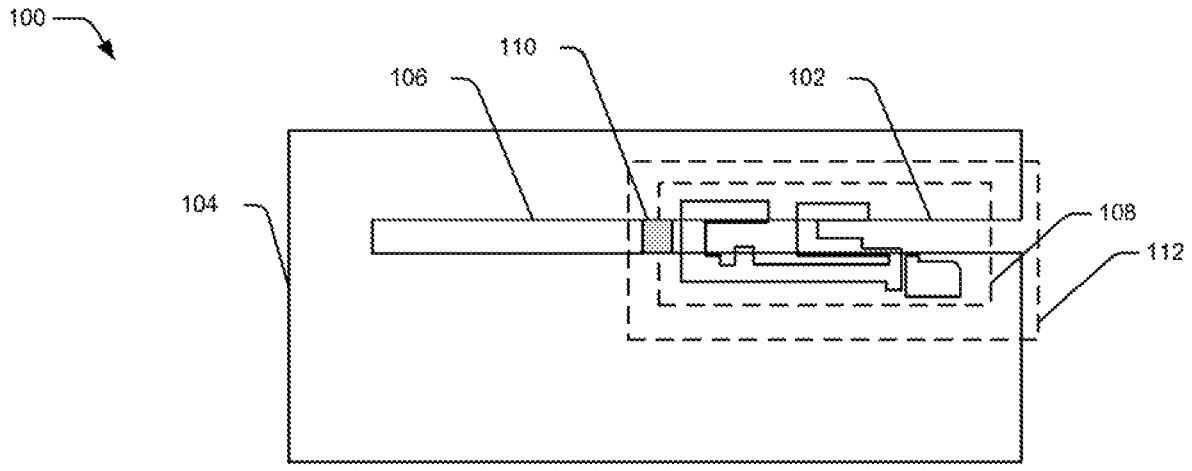
FIG. 1 illustrates a schematic representation of an integrated slot antenna, in accordance with an example implementation of the present subject mater.

Electronic devices are generally compact in size and space available within housing of such devices, to accommodate components, is scarce. The components fitted into the electronic device such as, wireless antennas to provide wireless communication, generally occupy a defined space within the housing of the electronic devices. To provide additional functionality such as, communication in different range of frequencies, additional wireless antennas have to be accommodated within the housing of the electronic devices. However, such additional wireless antennas occupy extra space within the housing of the electronic devices and as a result, compactness of the electronic device is generally compromised with in order to accommodate such additional wireless antennas.

In accordance with an implementation of the present subject matter, an integrated slot antenna for enabling wireless communication to an electronic device is described. The integrated slot antenna can be accommodated in housing of the electronic device, to allow communication at different frequency ranges, without utilizing separate antennas for operation at different frequencies, or occupying additional space within the housing of the electronic device.

In an example implementation of the present subject matter, the integrated slot antenna comprises a first slot, a second slot, and a separating member to separate the first slot and the second slot. The first slot and the second slot may allow operation of the integrated slot antenna at different range of frequencies. In an example, the first slot of the integrated slot antenna is an open-ended slot and is coupled to a first antenna member to form a first slot antenna. Further, the second slot of the integrated slot antenna is a closed-ended slot and is coupled to a second antenna member to form a second slot antenna. The first slot antenna and the second slot antenna may operate at a first predetermined range of frequencies and a second predetermined range of frequencies, respectively. It would be noted that the first antenna member, and the second antenna member may include different antenna components, such as feeder lines and ground plates incorporated within the housing, to form the first slot antenna and the second slot antenna, allowing the antennas to resonate at different frequencies.

In an example implementation of the present subject matter, the integrated slot antenna may allow the second slot to operate in a slot mode, such that during operation of the first slot antenna at the first predetermined range of frequencies, the second slot resonates along with the first slot antenna. In such an example, the first slot of the integrated slot antenna may be coupled with the first antenna member, while the second slot is left idle. While the second slot is operating in the slot mode, the space above the second slot may be utilized for accommodating multiple components of the electronic device. For instance, a camera module and an auto light sensor may be disposed over the second slot, and the space within the electronic device may be effectively utilized.

Thus, the described integrated slot antenna enhances the space efficiency of the electronic device by providing two slot antennas as an integrated slot antenna, without utilizing additional space within the electronic device. For example, the integrated slot antenna may be utilized to operate simultaneously in a frequencies of Long Term Evolution (LTE) communication standard and frequencies of Wireless Local Area Network (WLAN) communication standard while the total length of the integrated slot antenna is about 60 mm to 110 mm. The first slot antenna may operate in the frequencies of LTE communication standard and the second slot antenna may operate in the frequencies of the WLAN standard, without occupying additional space within the housing of the electronic device.

It would be noted that the frequencies on which the first slot antenna and the second slot antenna may operate, may not be limited to frequency bands of LTE communication standard or WLAN communication standard, and the integrated slot antennas may operate in different range of frequencies. Further, in an example, the frequencies of operation of the first slot antenna and the second slot antenna may partially overlap for diversity or Multiple Input Multiple Output (MIMO) application. Therefore, the described integrated slot antenna may allow operation of the antennas at two different operating frequency ranges, without occupying additional space within the housing of the electronic device.

The above described techniques are further described with reference to FIG. 1 to FIG. 5. It should be noted that the description and figures merely illustrate the principles of the present subject matter along with examples described herein and, should not be construed as a limitation to the present subject matter. It is thus noted that various arrangements may be devised that, although not explicitly described or shown herein, describe the principles of the present subject matter. Moreover, all statements herein reciting principles, aspects, and examples of the present subject matter, as well as specific examples thereof, are intended to encompass equivalents thereof.

FIG. 1 schematically illustrates an integrated slot antenna 100 for an electronic device, (not shown in FIG. 1), according to an implementation of the present subject matter. The electronic device can be for example, a laptop, a smartphone, a tablet, a notebook, and a Personal Digital Assistant (PDA). In an example, the integrated slot antenna 100 may be accommodated within a metallic part of the electronic device. For example, the integrated slot antenna 100 may be accommodated within a housing (not shown in FIG. 1) of the electronic device. In an example, where an electronic device, such as a laptop comprises a two-part housing, the integrated slot antenna 100 may be present on either part of the housing.

In an example implementation of the present subject matter, the integrated slot antenna 100 includes a first slot 102 on a metal body 104, a second slot 106 on the metal body 104, a first antenna member 108, and a separating member 110 is combined with metal body 104 to separate the first slot 102 and the second slot 106. The metal body 104, for instance, may be the housing of the electronic device.

In an example implementation of the present subject matter, the first slot 102 of the integrated slot antenna 100 is an open-ended slot, and is coupled to the first antenna member 108 to form a first slot antenna 112. In an example, the first slot antenna 112 operates in a first predetermined range of frequencies to provide wireless communication to the electronic device. In one example, the first predetermined range of frequencies may correspond to Long-Term Evolution (LTE) communication standard.

In an example implementation of the present subject matter, the second slot 106 is etched on the metal body 104 adjacent to the first slot 102 and is separated from the first slot 102 by the separating member 110, etched in between the first slot 102 and the second slot 106 on the metal body 104. In an example, the second slot 106 is a close-ended slot and may operate in either a slot mode or an antenna mode. While the second slot 106 may operate in a slot mode, the second slot 106 may enhance performance of the first slot 102. However, if the second slot 106 may operate in the antenna mode, the second slot 106 may be coupled to a second antenna member to form a second slot antenna and operate in a second predetermined range of frequencies.

Figure 2:
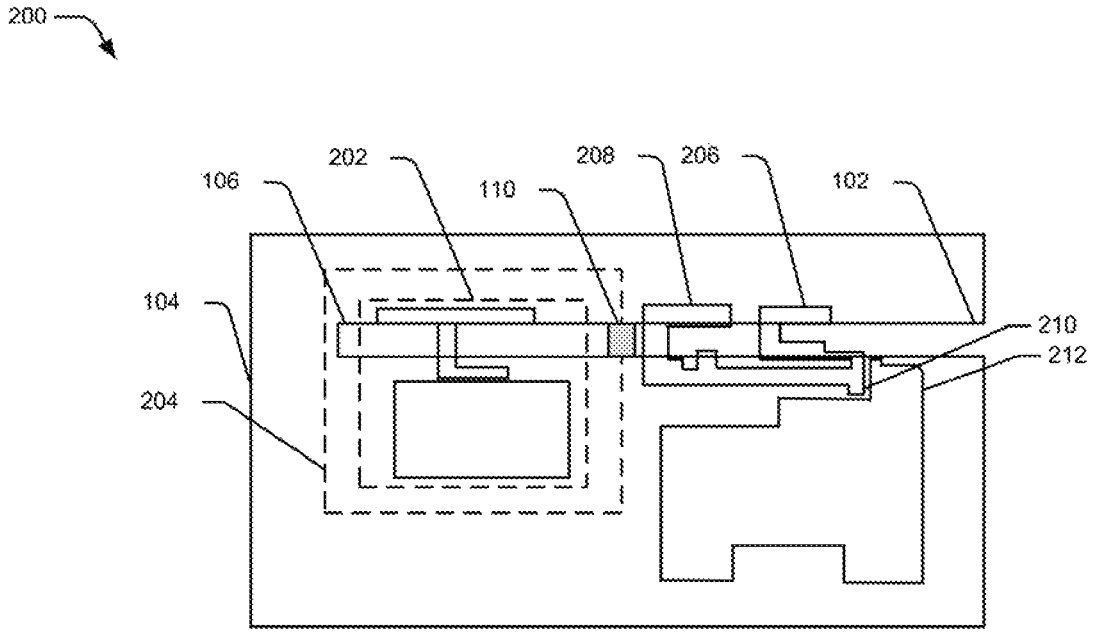
FIG. 2 illustrates a schematic representation of an integrated slot antenna, in accordance with an example implementation of the present subject matter.

The detailed explanation of working of the integrated slot antenna 100 has been further explained in conjunction with description of FIG. 2.

FIG. 2 schematically illustrates an integrated slot antenna 200, according to an example implementation of the present subject matter. The integrated slot antenna 200 may be accommodated within the housing of the electronic device to facilitate wireless communication of the electronic device with a communication network.

In an example, the communication network may include a Wireless Wide Area Network (WWAN), such as Long Term Evolution (LTE), WiMAX or a Wireless Local Area Network (WLAN) for Wi-FI communication. In one example, the integrated slot antenna 200 operates at different generations of communication standards such as, second, third, fourth, and fifth generations of radio frequency communication. Further, the wireless communication between the integrated slot antenna 200 and the communication network may be performed based on communication standard to which the electronic device may adhere to, such as the Internet Protocol (IP).

In an example implementation of the present subject matter, the integrated slot antenna 200 may include, apart from the first slot 102, the second slot 106, the first antenna member 108, and the separating member 110, a second antenna member 202. In an example, the first slot 102 may have different shapes, for instance, one of a U-shape, a L-shape, and a F-shape and the second slot 106 may have one of a U-shape, a L-shape, and a F-shape.

Further, the first slot 102 may be coupled to the first antenna member 108 to form the first slot antenna 112, as described earlier. In an example, the second antenna member 202 may be coupled to the second slot 106 to form a second slot antenna 204. Therefore, the first slot 102 and the second slot 106, coupled to each of the first antenna member 108 and the second antenna member 202, may form the first slot antenna 112 and the second slot antenna 204, respectively. Thus, the integrated slot antenna 200 may include two slot antennas, separated by the separating member 110.

Further, the separating member 110, in one example, may be a metal rib disposed in between the first slot 102 and the second slot 106 to separate the first slot 104 from the second slot 106. Further, the separating member 110 may isolate communication of the first slot antenna 112 from the communication of the second slot antenna 204 and reduce interference of signals between the first slot antenna 112 and the second slot antenna 204.

As described earlier, the first slot antenna 112 may operate in a first predetermined range of frequencies and the second slot antenna 204 may operate in a second predetermined range of frequencies. As an example, the integrated slot antenna 200 has been described to operate in two different range of frequencies, such as frequencies of Long Term Evolution (LTE) communication standard and frequencies of Wireless Local Area Network (WLAN) communication standard. Accordingly, the length of the first slot 102 and the second slot 106, along with their operation of the integrated slot antenna 200 has been described. However, it would be noted that the integrated slot antenna 200 may operate in other range of frequencies as well, and the length of the first slot 102 and the second slot 106 may accordingly be varied.

In an example implementation, while the first slot antenna 112 operates in the first predetermined range of frequencies, such as the frequencies of LTE communication standard, the first slot 102 is etched on the metal body 104 for a length of about 40 mm to about 100 mm. In an example, the length of the first slot 102 is selected based on the operating frequency of the first slot 102*lt* would be noted that the first slot antenna 112, being with slot length of about 40 to 100 mm, may provide a wideband operation, generally used for wireless communication of electronic devices.

Similarly, in an example, length of the second slot 106 may be within a range of about 20 mm to 50 mm, based on operating frequency of the second slot 106. Therefore, total length occupied by the integrated slot antenna 200 is about 60 mm to 150 mm within the housing of the electronic device.

In an example implementation, antenna members coupled to the first slot 102 and the second slot 106 may include various antenna components, such as feeders, ground plates and arms of an antenna. For example, the first antenna member 108 may include a first arm 206, a second arm 208, a feeder 210 and a ground 212. Further, the first slot 102 and the first antenna member 108 may be coupled such that at least one of the first arm 206 and the second arm 208 extend across the first slot 102 on one end, and the first arm 206 and the second arm 208 are coupled to the feeder 210 and the ground 212 on the opposite end. Similarly, the second antenna member 202 may also include one or more arms coupled to respective feeder 210 and ground 212.

In an example implementation, the arms of the antenna members may have different geometry, such as shape, size and thickness, to achieve operation at different frequencies and provide a wideband operation to the integrated slot antenna 200. For example, the first arm 206 and the second arm 208 may have an inverted U-shape or L-shape, and the second arm 208 may be thicker than the first arm 206, and based on the size or shape, the first arm 206 may allow operation in a frequency of about 0.7 Giga Hertz (GHz) to 1.7 GHZ and 2.4 GHz to 2.7 GHz, and the second arm 208 may allow operation in a frequency of about 1.5 GHz to 2.7 GHz.

As described earlier, the integrated slot antenna 200 may allow the second slot 106 to operate in a slot mode or in the antenna mode as the second slot antenna 204. Accordingly, the second slot 106 is operated in the slot mode and the space above the second slot 106 may be used for accommodating multiple components of the electronic device. For instance, a camera module, and a light detection module of the electronic device may be disposed in the space above the second slot 106. Therefore, while being operated in the slot mode, the integrated slot antenna 200 may provide additional space for accommodating multiple components, thereby enhancing space efficiency of the electronic device.

In another example, while the second slot 106 is being operated in the antenna mode as the second slot antenna 204, the second slot 106 may be coupled to the second antenna member 202 to form the second slot antenna 204. In an example implementation of the present subject matter, the second slot antenna 204 may operate in the second predetermined range of frequencies, for instance 2.4 and 5 GHz bands for WLAN application. In an example, when the second slot 106 is being utilized as the second slot antenna 204, space above the second slot antenna may be used to accommodate a component of the electronic device.

In an example, the second slot antenna 204 may operate in frequencies of various communication standards, such as frequency of about 2300 MHz for LTE B66 standard, 2500 to 2700 MHz for B7 standard operating bands, and at about 2.4 GHz for in Wi-Fi operating frequency. The integrated slot antenna 200, thus allows integration of two slot antennas within the defined space, while operating in different but partially overlapped frequency bands for diversity and MIMO application.

It would be noted that the first predetermined range of frequencies and the second predetermined range of frequencies may have an overlap of some operating frequencies, depending upon the operation of the integrated slot antenna 200.

Figure 3:
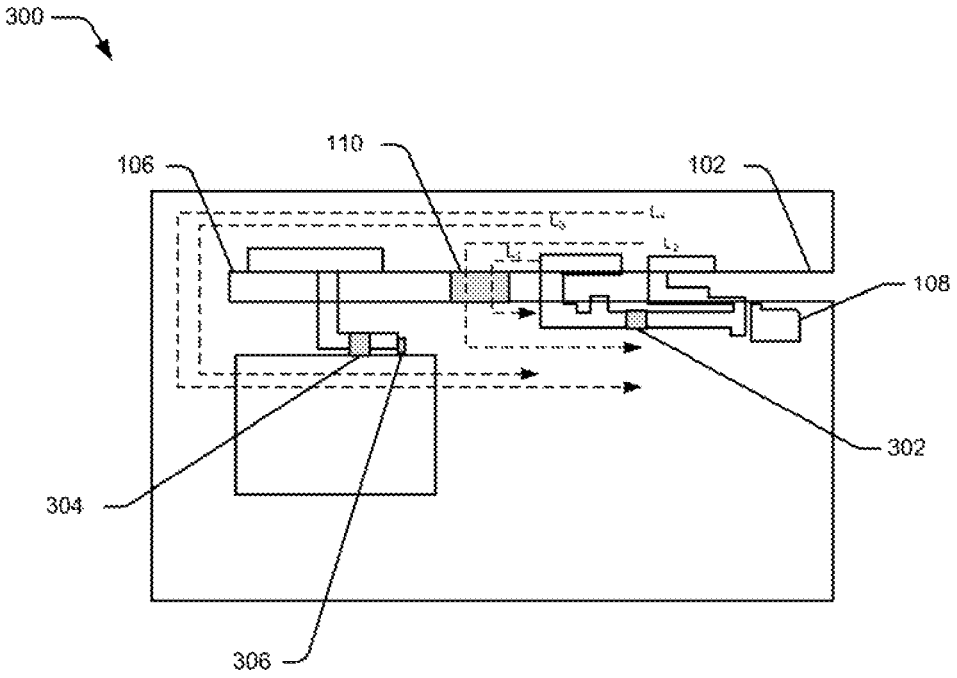
FIG. 3 illustrates a schematic representation of an integrated slot antenna, in accordance with an example implementation of the present subject matter.

FIG. 3 illustrates another example integrated slot antenna 300, according to an implementation of the present subject matter. The integrated slot antenna 300 comprises the first slot 102 coupled to the first antenna member 108 to form the first slot antenna 112 and the second slot 106 coupled to the second antenna member 202 to form the second slot antenna 204.

In an example implementation of the present subject matter, the first antenna member 108 includes, apart from the first arm 206, the second arm 208, the feeder 210, and the ground 212, a first tunable component 302. In one example, the first tunable component 302 is disposed in between the first arm 206 and the second arm 208 of the first antenna member 108. The first tunable component 302 may include a circuit including passive components such as resistors, capacitor, and inductor as well as active components such as MEMS, varactor, diode, and switch to regulate impedance for the first slot antenna 112 to communicate at the first predetermined range of frequencies. The first tunable component 302 may also be coupled to the ground 212 of the first antenna member 108.

In an example implementation of the present subject matter, the second slot antenna 204 comprising of the second slot 106 and the second antenna member 202, may also include a second tunable component 304. The second tunable component 304 may also include passive components such as resistors, capacitor, and inductor as well as active components such as MEMS, varactor, diode, and switch to provide impedance regulation for communication of the second slot antenna 204 at second predetermined range of frequencies.

In an example implementation of the present subject matter, the second slot antenna 204 is coupled to an antenna switch 306. The antenna switch 306 can be for instance, a two-way antenna switch or a three-way antenna switch. In an example, the antenna switch may allow selection of an antenna to operate between two or more communication standards. For example, the antenna switch 306 may toggle operation of the second slot antenna 204 in between WLAN communication standard and LTE communication standard.

In operation, the first slot antenna 112 of the integrated slot antenna 300 may communicate at the first predetermined range of frequencies to transmit and receive signals. In one example, the first predetermined range of frequencies correspond to LTE communication standard. For facilitating the wireless communication at the first predetermined range of frequencies, the first tunable component 302 may adjust the impedance of the first slot antenna 112 for wireless communication.

In an example, each of the first arm 206 and the second arm 208 may operate in two modes to achieve resonant modes in the frequency response of the integrated slot antenna 300. Each resonant mode corresponds to ¼ of guided wavelength of the signals for wireless communication. The two modes of operation may be based on lengths of the first slot 102 and second slot 106 excited by the first arm 206 and the second arm 208 respectively. For instance, the first arm 206 may excite a length $L_2$ of the first slot 102 to have a resonant mode during operation, and the second arm 208 may excite the length $L_1$ of the first slot 102 to have another resonant mode during operation such as, operation of high frequencies of about 1.5 GHz to about 2.7 GHz.

In a similar manner, the first arm 206 may also excite a length $L_4$ of the first slot 102 and the second slot 106, and the second arm 208 may excite a length $L_3$ of the first slot 102 and second slot 106 to have an operation at low frequencies, for instance, about 700 MHz. Therefore, it would be noted that each arm of the first antenna member 108 may excite two resonant frequencies, based on the exciting lengths, and therefore, two arms of the first antenna member 108 may allow the first slot antenna 112 to resonate at 4 different frequencies, based on the resonant lengths $L_1$, $L_2$, $L_3$, and $L_4$.

As explained earlier, the second slot antenna 204 may operate at the second predetermined range of frequencies to provide communication to the integrated slot antenna 300. In an example, the antenna switch 306 may facilitate switching between two different operating modes, such as the LTE and WLAN mode of communication.

Therefore, it would be noted that the shape, size and placement of the arms in the first slot antenna 112 and the second slot antenna 204 may allow for adjustment in the resonating frequencies of the integrated slot antenna 300. Further, based on the antenna switch 306, the operation of the antenna may also be varied.

Figure 4:
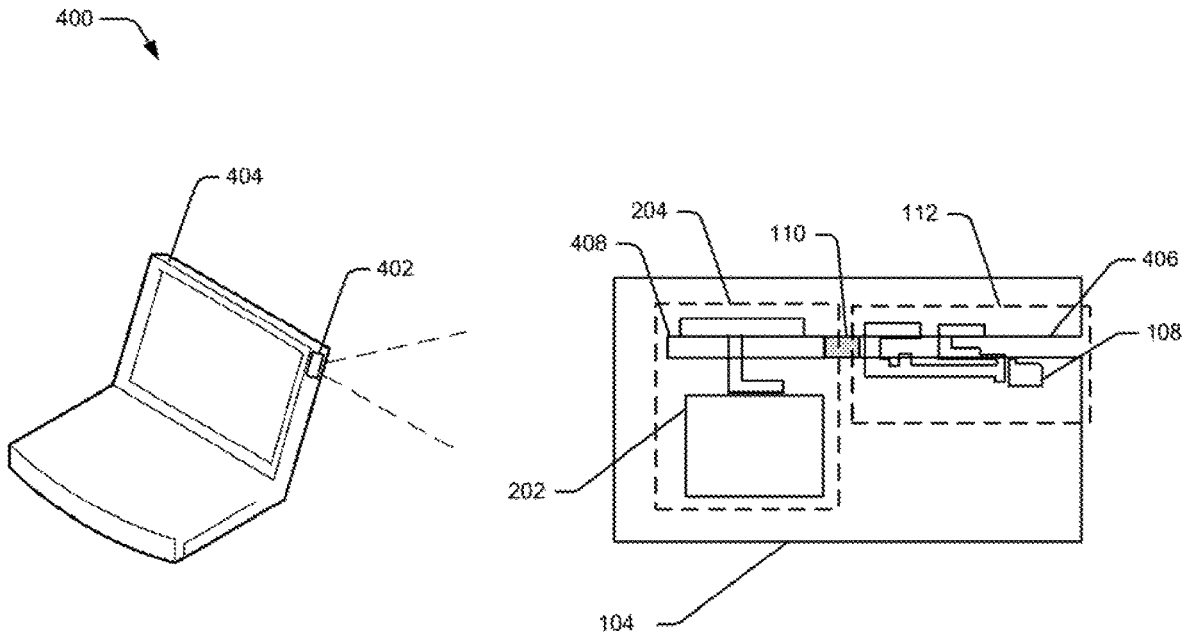
FIG. 4 illustrates an example electronic device comprising an integrated slot antenna, according to an example implementation of the present subject matter.

FIG. 4 schematically illustrates an electronic device 400, implementing an integrated slot antenna 402, according to an example implementation of the present subject matter. The electronic device may be a laptop, a notebook, a Personal Digital Assistant (PDA). The electronic device may comprise a housing 404 in which the integrated slot antenna 402 is incorporated. In an example, the housing 404 has two parts, an upper part to accommodate components such as, a display screen surrounded by a bezel, and a lower part to accommodate components such as, a keypad. The integrated slot antenna 402 may be incorporated in the upper part of the housing 404, and beneath the bezel.

The integrated slot antenna 402 comprises the first slot antenna 112, the separating member 110, and the second slot antenna 204. In an example implementation of the present subject matter, the first slot antenna 112 may include the first antenna member 108 coupled to an open-ended first slot 406. In an example, the first slot antenna 112 may communicate in a first predetermined rage of frequencies.

In an example, the separating member 110 is etched on the metal body 104 in between the open-ended first slot 406 and a close-ended second slot 408 to separate the open-ended first slot 406 and the close-ended second slot 408. As described earlier, the separating member 110 isolates the open-ended first slot 406 and the close-ended second slot 408 and may prevent any interference of signals communicated by the first slot antenna 112 and the second slot antenna 204. In an example implementation of the present subject matter, the second slot antenna 204 comprises the second antenna member 202 coupled to the close-ended second slot 408 in the metal body 104, and may operate in a second predetermined range of frequencies, as described earlier.

Figure 5:
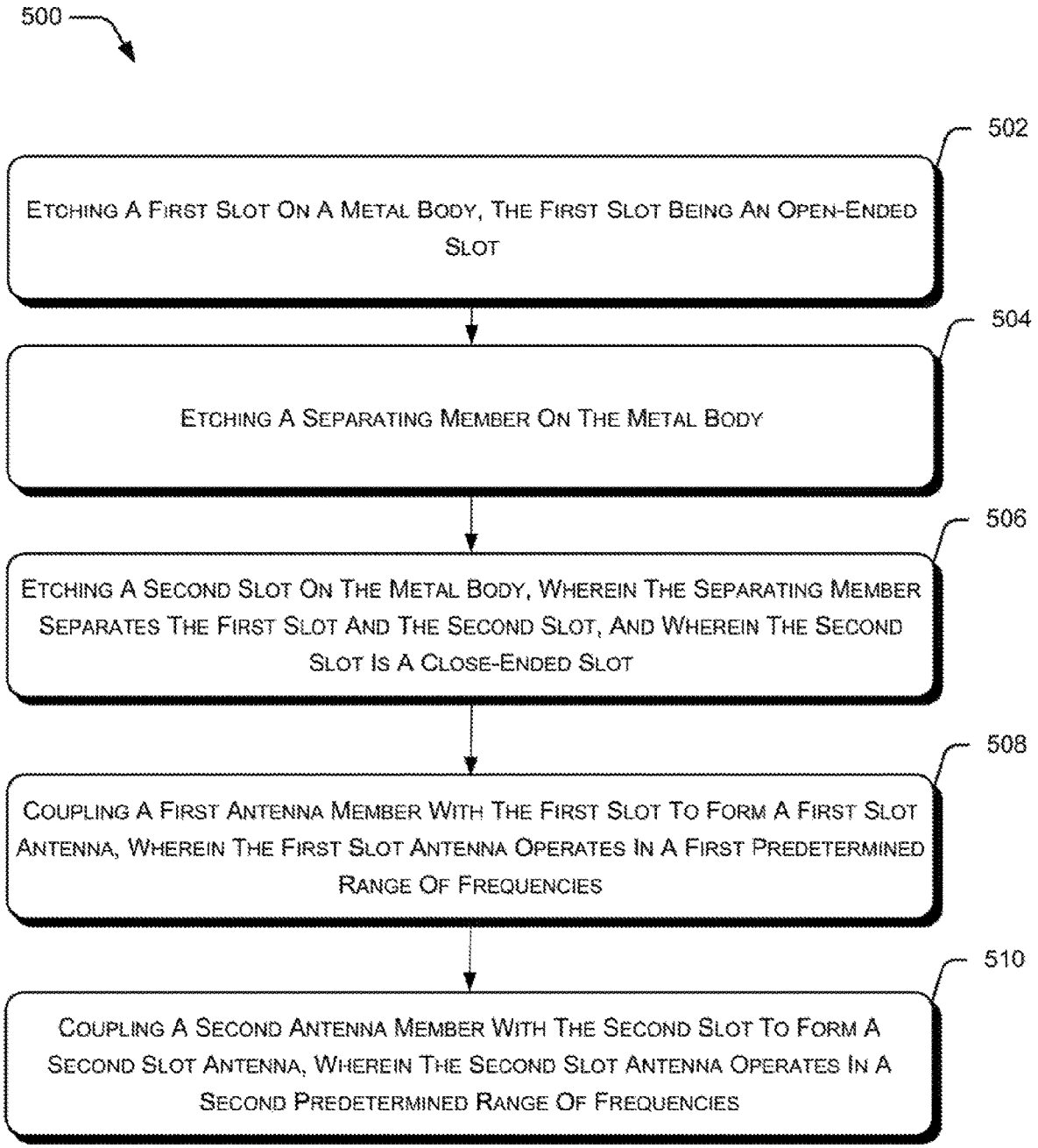
FIG. 5 illustrates an example method for fabricating an integrated slot antenna, according to an implementation of the present subject matter.

FIG. 5 illustrates a method 500 for fabricating an integrated slot antenna. In an example, the integrated slot antenna may be one of the integrated slot antenna 100, the integrated slot antenna 200, the integrated slot antenna 300, and the integrated slot antenna 402, as described earlier. The order in which the method 500 is described is not intended to be construed as a limitation, and any number of the described method blocks may be combined in any order to implement the method 500, or an alternative method. In an example implementation of the present subject matter, the method is described in reference to fabrication of the integrated slot antenna 200, as described earlier, however, it would be appreciated that the method 500 may also be implemented to fabricate other integrated slot antennas.

Referring to FIG. 5, in an implementation of the present subject matter, at block 502, a first slot is etched on a metal body. The first slot may be an open-ended slot. In an example, the first slot 102 may be etched on the metal body 104. At block 504, a separating member is etched on the metal body. The separating member can be, for instance a metal rib to separate the first slot and a second slot. Thereafter, the second slot is etched on the metal body wherein the second slot is a close-ended slot, at block 506.

After etching the second slot, a first antenna member is coupled to the second slot to form a first slot antenna at block 508. In an example implementation of the present subject matter, the first slot antenna may operate in a first predetermined range of frequencies.

At block 510, a second antenna member is coupled to a second slot to form a second slot antenna. In an example implementation of the present subject matter, the second slot antenna may operate in a second predetermined range of frequencies. In an example, the first slot and the second slot are etched in such a manner that total length of the first slot is an open-ended slot and the second slot is a closed ended slot. Further, the coupling of the first antenna member with the first slot, and the second antenna member with the second slot to for the first slot antenna and the second slot antenna, respectively, allows for integration of two slot antennas.

In an example implementation of the present subject matter, the total length of the first slot is about 60 mm to 110 mm, and length of the second slot is about 20 mm to 50 mm. In another example, a tunable component, for instance the first tunable component 302, and the second tunable component 304, may be coupled to the first antenna member 108, and second antenna member 202, respectively, to regulate impedance matching.

Thus, the described integrated slot antenna enhances the space efficiency of the electronic device, by providing two slot antennas as an integrated slot antenna, within defined space of the housing and allows operation in two different operating frequencies.

Although implementations of present subject matter have been described in language specific to structural features and/or methods, it is to be noted that the present subject matter is not limited to the specific features or methods described. Rather, the specific features and methods are disclosed and explained in the context of a few implementations for the present subject matter.

We claim:

1. An integrated slot antenna for an electronic device comprising:

a first slot in a metal body coupled to a first antenna member to form a first slot antenna, wherein the first slot antenna is to operate in a first predetermined range of frequencies, and wherein the first slot is an open-ended slot; and a second slot in the metal body separated from the first slot, wherein the second slot is a close-ended slot; and a separating member to separate the first slot and the second slot.

2. The integrated slot antenna as claimed in claim 1, wherein the second slot is coupled to a second antenna member to form a second slot antenna, the second slot antenna is to operate in a second predetermined range of frequencies.

3. The integrated slot antenna as claimed in claim 1, wherein the first slot antenna operates in frequencies of LTE communication standard.

4. The integrated slot antenna as claimed in claim 1, wherein length of the first slot is within a range of about 40 millimeters (mm) to 100 mm, and wherein length of the second slot is about 20 mm to 50 mm.

5. The integrated slot antenna as claimed in claim 1, wherein the second slot operates in one of a slot mode and an antenna mode, wherein the second slot is to resonate along with the first slot antenna during operation in the slot mode.

6. The integrated slot antenna as claimed in claim 5, wherein the second slot is disposed beneath at least a component of the electronic device in the slot mode.

7. An electronic device comprising an integrated slot antenna, wherein the integrated slot antenna comprises:

a first slot antenna to operate in a first predetermined range of frequencies, wherein the first slot antenna comprises a first antenna member coupled to an open-ended first slot in a metal body;

a separating member disposed between the open-ended first slot and a close-ended second slot; and a second slot antenna to communicate in a second predetermined range of frequencies, wherein the second slot antenna comprises a second antenna member coupled to the close-ended second slot in the metal body.

8. The electronic device as claimed in claim 7 further comprising a tunable component coupled to the first antenna member for impedance regulation.

9. The electronic device as claimed in claim 7, wherein the open-ended first slot has at least one of a L-shape, a U-shape and a F-shape, and the close-ended second slot has at least one of a L-shape, a U-shape, and a F-shape.

10. The electronic device as claimed in claim 7, wherein the first antenna member comprises:

a first arm; and a second arm, wherein the first arm and the second arm are coupled to a feeder of the first antenna member to operate in the first predetermined range of frequencies, and at least one of the first arm and the second arm extends across the first slot.

11. The electronic device as claimed in claim 7, wherein the second slot antenna is coupled to an antenna switch, wherein the antenna switch comprises an electric control pin to toggle operation of the second slot antenna in between WLAN communication standard and LTE communication standard.

12. The electronic device as claimed in claim 7, wherein the first slot antenna operates in frequencies of Long-term Evolution (LTE) communication standard and the second slot antenna operates in frequencies of Wireless Local Area Network (WLAN) communication standard.

13. A method of fabricating an integrated slot antenna comprising:

etching a first slot on a metal body, the first slot being an open-ended slot;

etching a separating member on the metal body;

etching a second slot on the metal body, wherein the separating member separates the first slot and the second slot, and wherein the second slot is a close-ended slot;

coupling a first antenna member on the first slot to form a first slot antenna, wherein the first slot antenna operates in a first predetermined range of frequencies; and coupling a second antenna member on the second slot to form a second slot antenna, wherein the second slot antenna operates in a second predetermined range of frequencies.

14. The method as claimed in claim 13, wherein the etching of the first slot and the second slot is for a total length of about 60 mm to 110 mm, and wherein the etching of the second slot is for a length of about 20 mm to 50 mm.

15. The method as claimed in claim 13, further comprising coupling a tunable component to the second antenna member for impedance regulation.

* * * * *